US007918154B2

(12) United States Patent
Igarashi

(10) Patent No.: US 7,918,154 B2
(45) Date of Patent: Apr. 5, 2011

(54) PRESSURE BOOSTER

(75) Inventor: Tadashi Igarashi, Koshigaya (JP)

(73) Assignee: SMC Kabushiki Kaisha, Tokyo (JP)

( * ) Notice: Subject to any disclaimer, the term of this patent is extended or adjusted under 35 U.S.C. 154(b) by 404 days.

(21) Appl. No.: 12/045,703

(22) Filed: Mar. 11, 2008

(65) Prior Publication Data

US 2008/0223206 A1 Sep. 18, 2008

(30) Foreign Application Priority Data

Mar. 12, 2007 (JP) ..... 2007-061231

(51) Int. Cl.
*F15B 3/00* (2006.01)
*F15B 15/14* (2006.01)

(52) U.S. Cl. ..... 92/187; 92/129

(58) Field of Classification Search ..... 92/84, 129, 92/187; 91/286
See application file for complete search history.

(56) References Cited

U.S. PATENT DOCUMENTS

| | | | | |
|---|---|---|---|---|
| 2,436,908 | A * | 3/1948 | Van Weenen et al. | 92/187 |
| 4,069,747 | A | 1/1978 | Forry et al. | |
| 4,674,958 | A * | 6/1987 | Igarashi et al. | 417/225 |
| 4,761,118 | A * | 8/1988 | Zanarini | 92/129 |
| 4,767,282 | A * | 8/1988 | Igarashi et al. | 417/225 |
| 5,442,993 | A | 8/1995 | Baliotti, II et al. | |
| 5,758,985 | A | 6/1998 | Yuda | |
| 6,126,413 | A * | 10/2000 | Berke-Joergensen | 417/401 |
| 6,981,429 | B2 | 1/2006 | Maisch et al. | |

FOREIGN PATENT DOCUMENTS

| | | |
|---|---|---|
| DE | 102 43 047 | 3/2004 |
| JP | 56-102801 | 8/1981 |
| JP | 60-015266 | 1/1985 |
| JP | 63-190577 | 12/1988 |
| JP | 05-083411 | 11/1993 |
| JP | 09-507560 | 7/1997 |
| JP | 10-47309 | 2/1998 |
| JP | 10-267002 | 10/1998 |
| JP | 10267002 A * | 10/1998 |
| JP | 11-002211 | 1/1999 |

* cited by examiner

*Primary Examiner* — Thomas E Lazo
(74) *Attorney, Agent, or Firm* — Paul A. Guss

(57) ABSTRACT

In a pressure booster having a cylinder mechanism, a floating mechanism is disposed between pistons and a piston rod, the floating mechanism being capable of absorbing offset (off centered) loads that are imposed on the pistons from the piston rod. The floating mechanism is constituted from swing bolts connected to both ends of the piston rod, support plates mounted onto end surfaces of the pistons and which swingably support the swing bolts therein, and fixing plates disposed between the ends of the piston rod and the support plates.

7 Claims, 7 Drawing Sheets

PRESSURE BOOSTER

BACKGROUND OF THE INVENTION

1. Field of the Invention

The present invention relates to a pressure booster for increasing the pressure of a pressure fluid by a reciprocating action of a piston and then outputting the pressure fluid.

2. Description of the Related Art

The present applicant has proposed a pressure booster, which is capable of increasing or boosting the pressure of a pressure fluid supplied to a pressure-increasing chamber by causing a reciprocating action of a piston disposed inside of a cylinder tube, and then outputting the pressure fluid (see, Japanese Laid-Open Patent Publication No. 10-267002). This pressure booster comprises a displaceable piston inside of the cylinder tube, wherein by displacing the piston under the pressing action of a pressure fluid supplied to a drive chamber of the cylinder tube, a pressure fluid, which resides within a pressure-increasing chamber formed on an opposite side from the drive chamber with respect to the piston, is increased or boosted in pressure, and the pressure fluid is output from an outlet port while passing through a check valve.

SUMMARY OF THE INVENTION

A principal object of the present invention is to provide a pressure booster, which enables smoother displacement of the piston thereof, thereby improving the durability of the pressure booster.

According to the present invention, there is provided a pressure booster having a supply port for supplying a pressure fluid, an outlet port through which a pressure fluid that has been increased in pressure is output, and a discharge port for discharging exhausted pressure fluid, wherein by a reciprocating movement of a pair of pistons that are connected to a piston rod and disposed respectively for displacement inside a pair of cylinder tubes, the pressure fluid that is introduced from the supply port is increased in pressure and output from the outlet port, comprising: a cylinder mechanism having a pair of cylinder tubes equipped with cylinder chambers to which pressure fluid is supplied, a pair of pistons disposed for displacement inside the cylinder tubes, and a piston rod connected to both of the pair of pistons; a center unit disposed between the cylinder tubes and having a switching section therein for switching a state of communication of the pressure fluid between the supply port and the outlet port and the cylinder chambers; and an offset absorbing mechanism disposed between the pistons and the piston rod, which is capable of absorbing an offset occurring between axial centers of the pistons and an axial center of the piston rod.

In the present invention, an offset absorbing mechanism is disposed between a pair of pistons and a piston rod, which make up the cylinder mechanism. In the event that the piston rod becomes off centered (or offset) with respect to the pistons and the cylinder tubes, the piston rod is displaced with respect to the pistons. Thus, the imparting of offset loads to the pistons from the piston rod can be prevented. Stated otherwise, offset loads imparted to the pistons from the piston rod can be suitably absorbed by the offset absorbing mechanism.

Accordingly, the outer circumferential surfaces of the pistons remain in abutment evenly along the inner circumferential surfaces of the cylinder chambers, thereby suppressing sliding resistance between the cylinder chambers and the pistons. Thus, the pistons can be displaced smoothly along the cylinder tubes, and the durability thereof can be enhanced.

The above and other objects features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
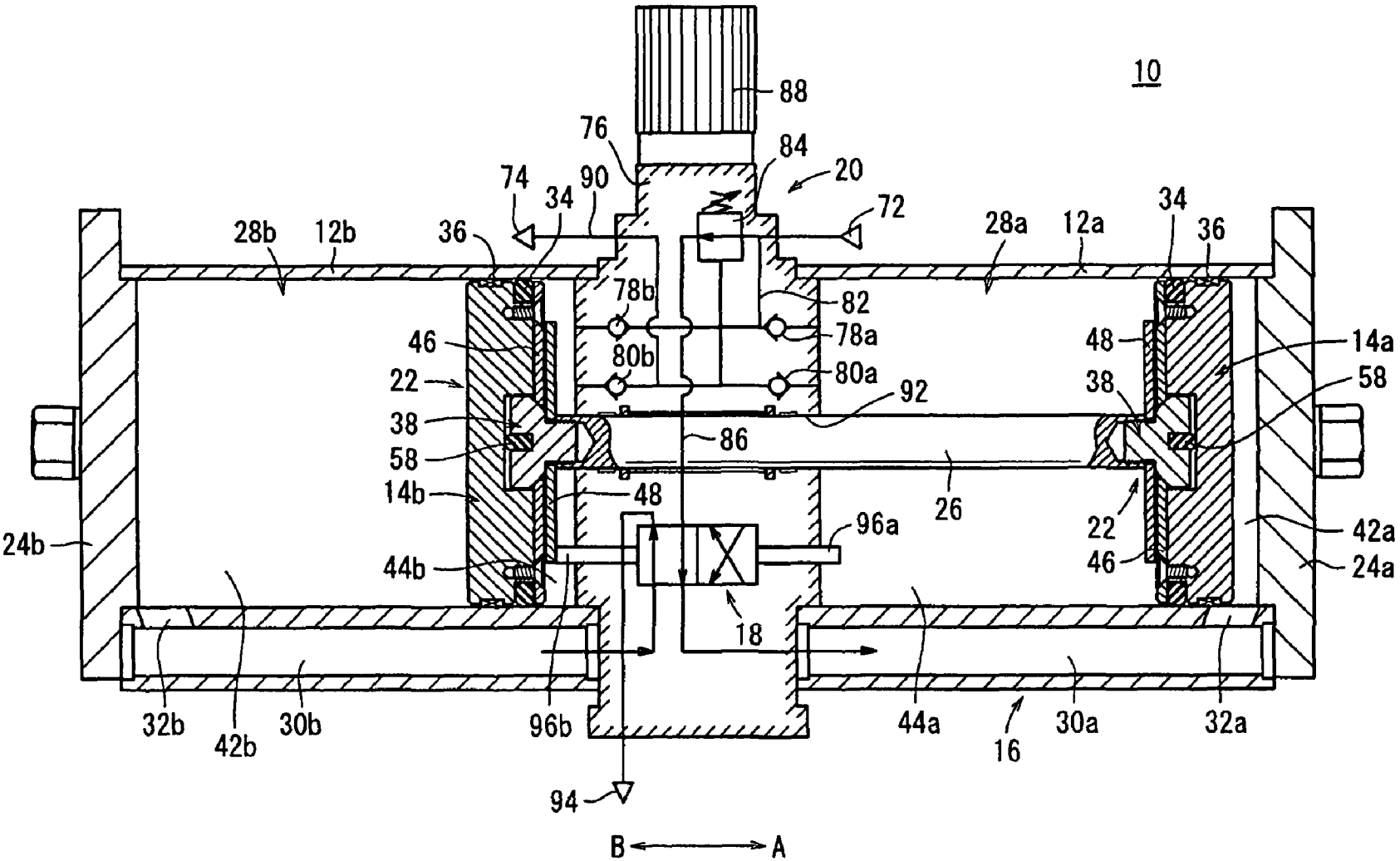
FIG. 1 is an overall vertical cross sectional view of a pressure booster according to a first embodiment of the present invention.

In FIG. 1, reference numeral 10 indicates a pressure booster according to a first embodiment of the present invention.

As shown in FIGS. 1 through 4, the pressure booster 10 is constituted from a pair of cylinder tubes 12*a*, 12*b*, a cylinder mechanism 16 including pistons 14*a*, 14*b* disposed inside the cylinder tubes 12*a*, 12*b*, a center unit 20 disposed between the cylinder tubes 12*a*, 12*b* and having a switching valve 18 therein for switching the fluid communication state of the pressure fluid, and floating mechanisms (offset absorbing mechanisms) 22 disposed in the cylinder mechanism 16, which are capable of absorbing offset loads with respect to the pistons 14*a*, 14*b*.

The cylinder mechanism 16 includes the pair of cylinder tubes 12*a*, 12*b*, which are formed in cylindrical shapes, a pair of end blocks 24*a*, 24*b* fitted to ends of the cylinder tubes 12*a*, 12*b* for closing the ends thereof, a pair of pistons 14*a*, 14*b* disposed respectively for displacement inside the cylinder tubes 12*a*, 12*b*, and a piston rod 26 interconnecting one piston 14*a* and the other piston 14*b* through the floating mechanisms 22.

The cylinder tubes 12*a*, 12*b* are formed in cylindrical shapes having a predetermined length along the axial direction (the direction of arrows A and B), having cylinder chambers 28*a*, 28*b* formed in the interior thereof through which the pistons 14*a*, 14*b* are inserted. Further, fluid passages 30*a*, 30*b* are formed in the cylinder tubes 12*a*, 12*b* in parallel with the cylinder chambers 28*a*, 28*b*. The fluid passages 30*a*, 30*b* are formed separately, respectively, as well as being separated from the cylinder chambers 28*a*, 28*b*. The fluid passages 30*a*, 30*b* communicate respectively, through communication conduits 32*a*, 32*b*, with end sides of the cylinder tubes 12*a*, 12*b* on which the end blocks 24*a*, 24*b* are mounted.

The pistons 14*a*, 14*b* are arranged displaceably inside the cylinder chambers 28*a*, 28*b* in the cylinder tubes 12*a*, 12*b*. Piston packings 34 and wear rings 36 are installed through annular grooves onto the outer circumferential surfaces of the pistons 14*a*, 14*b*. On the other hand, recesses 40, into which swing bolts (swinging members) 38 that constitute the floating mechanisms 22 are inserted, are formed in substantially central regions of the pistons 14*a*, 14*b*. The recesses 40 are formed so as to open toward sides of the piston rod 26, and the recesses 40 are disposed respectively on the axes of the pistons 14*a*, 14*b*.

The cylinder chambers 28*a*, 28*b* are made up from drive chambers 42*a*, 42*b*, which are disposed between the pistons 14*a*, 14*b* and the end blocks 24*a*, 24*b* and into which the pressure fluid is supplied and discharged, together with pressure-increasing chambers 44*a*, 44*b*, which are disposed between the pistons 14*a*, 14*b* and the center unit 20 and in which the pressure of the pressure fluid is increased or boosted. The drive chambers 42*a*, 42*b* communicate with the fluid passages 30*a*, 30*b* through the communication conduits 32*a*, 32*b*.

The floating mechanisms 22 include the swing bolts 38 connected to both ends of the piston rod 26, the support plates (supporting members) 46 mounted respectively on end surfaces of the pistons 14*a*, 14*b* and swingably supporting the swing bolts 38 therein, and fixing plates (abutment members) 48, which are disposed respectively between ends of the piston rod 26 and the support plates 46.

Each of the swing bolts 38 includes a small diameter portion 52 disposed on one end thereof, which is threaded into a screw hole 50 formed at an end of the piston rod 26, a large diameter portion 54 disposed on the other end thereof, which is expanded in diameter in a radially outward direction with respect to the small diameter portion 52, and a tapered portion 56 adjacent to the large diameter portion 54 that gradually is reduced in diameter toward the side of the small diameter portion 52.

Threads are engraved on the outer circumferential surface of the small diameter portion 52, and the small diameter portion 52 is screw-engaged with and connected to the piston rod 26 through such threads.

The large diameter portion 54 is formed to have a fixed diameter, which is roughly equivalent to the inner circumferential diameter of the recesses 40 in the pistons 14*a*, 14*b*. Each of the large diameter portions 54 of the swing bolts 38 is inserted into the recesses 40 that open on the end surfaces of the pistons 14*a*, 14*b*. At this time, the outer circumferential diameter of the large diameter portion 54 is formed to be just slightly smaller than the inner circumferential diameter of the recesses 40. More specifically, a clearance C1 (see FIG. 2) of a predetermined distance is disposed between the large diameter portion 54 and the recess 40.

Figure 2:
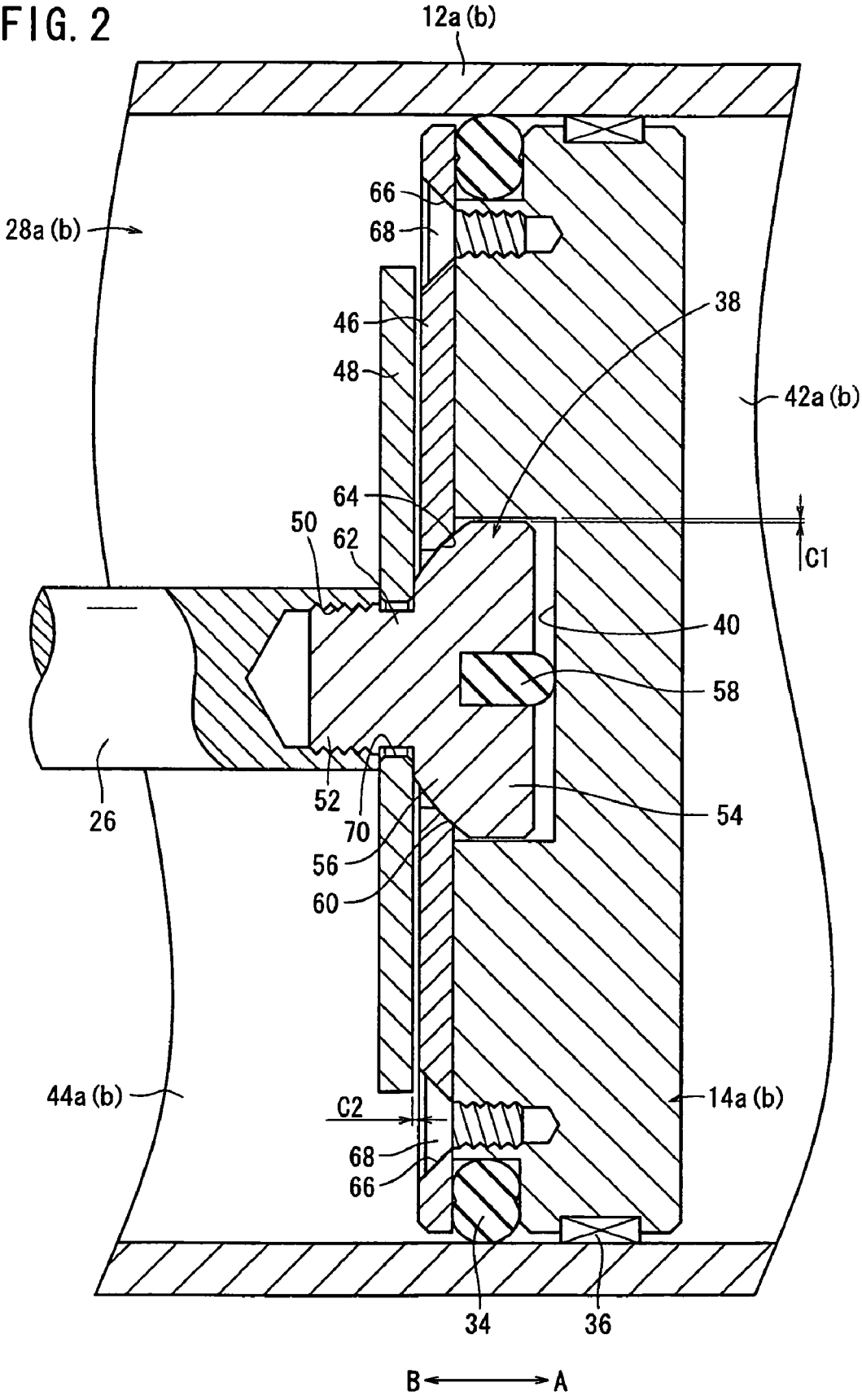
FIG. 2 is an enlarged cross sectional view showing the vicinity of a floating mechanism in the pressure booster of FIG. 1.
Figure 3:
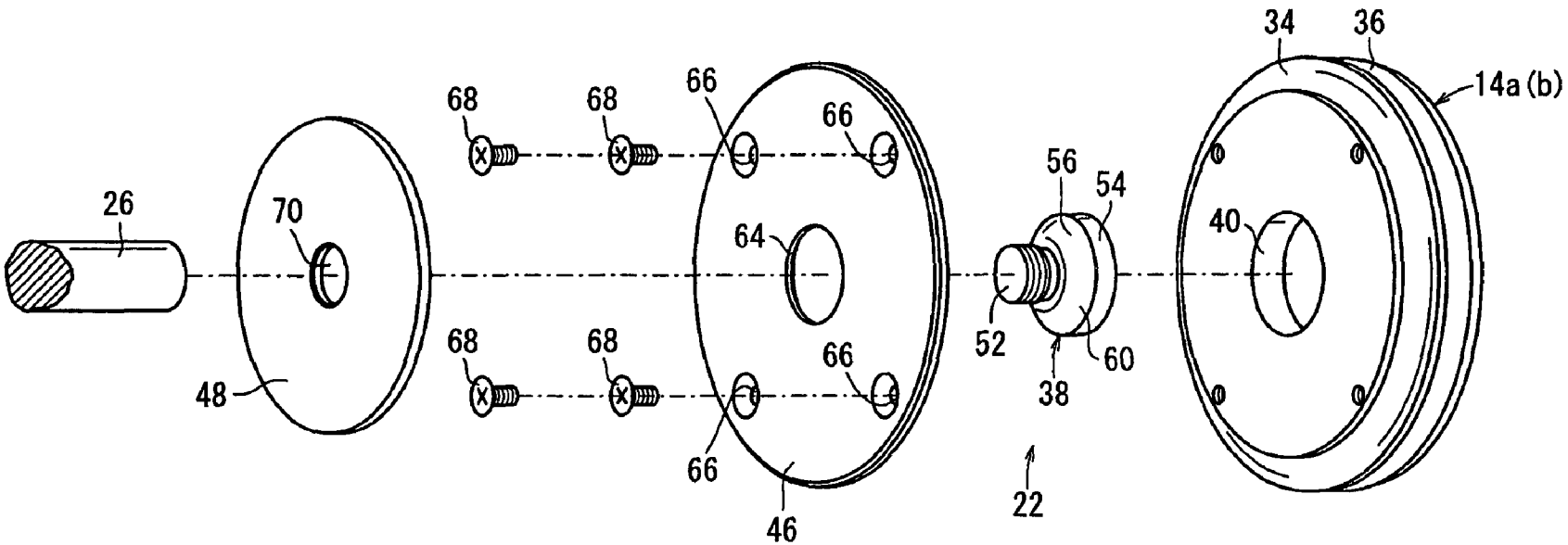
FIG. 3 is an exploded perspective view of the floating mechanism shown in FIG. 2.
Figure 4:
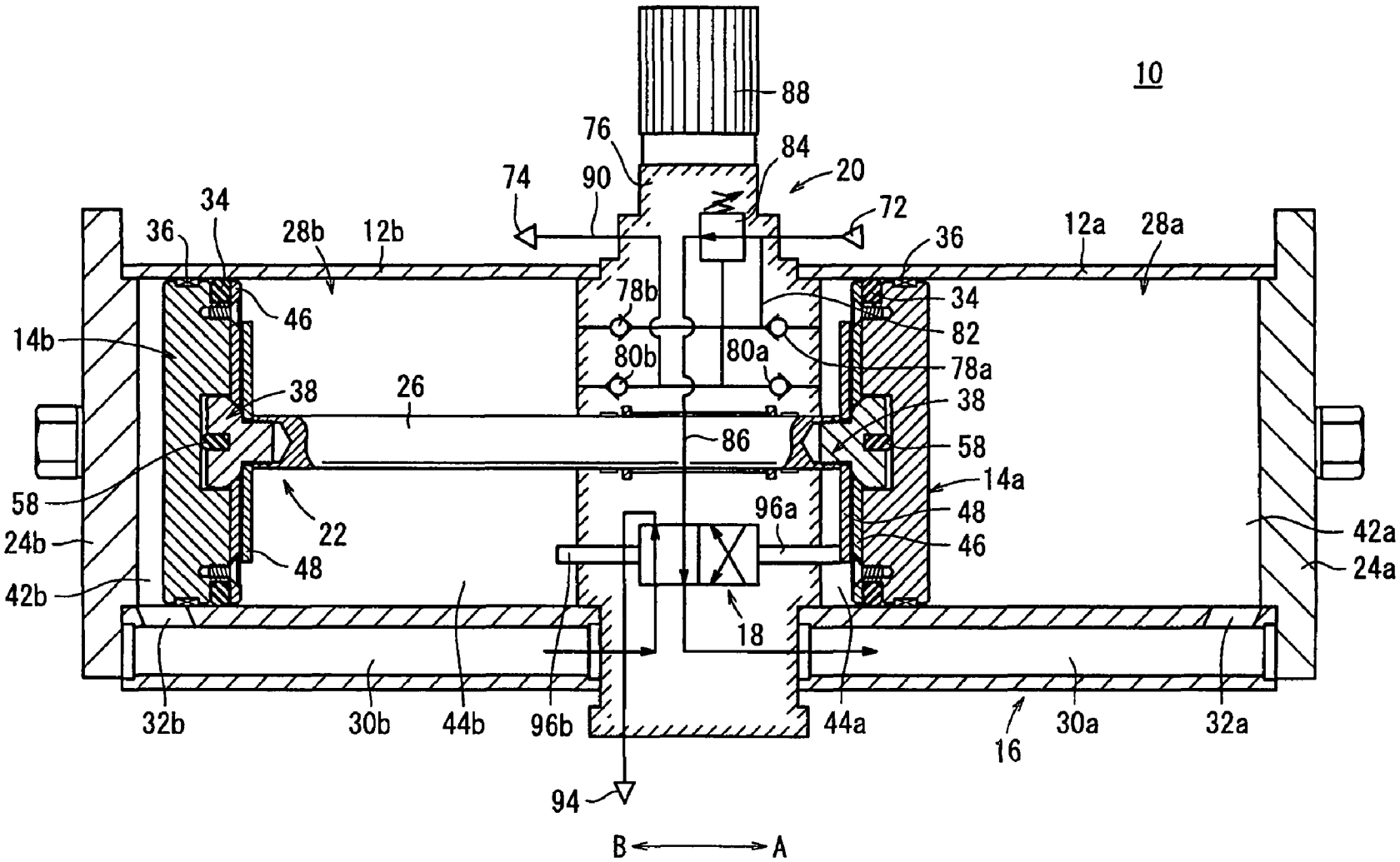
FIG. 4 is an overall vertical cross sectional view showing a state in which the piston is displaced, by a switching action of a switching valve, toward the side of another end block, in the pressure booster of FIG. 1.

As shown in FIG. 2, the clearance C1 is disposed in a perpendicular direction with respect to the displacement direction (the direction of arrows A and B) of the pistons 14*a*, 14*b* and the piston rod 26.

Further, a damper 58, which projects outwardly toward a bottom surface of the recess 40, is mounted in a hole formed in a central portion of the large diameter portion 54. The damper 58 is formed in a shaft-like shape from an elastic material such as rubber or the like, and by projecting outwardly with respect to the end surface of the large diameter portion 54, the damper 58 buffers shocks that result when the large diameter portion 54 and the recess 40 abut against one another.

The tapered portion 56 is disposed between the large diameter portion 54 and the small diameter portion 52. A curved surface 60 is included on the outer surface thereof, which bulges with a circular arc shape in cross section toward the outer side. The tapered portion 56 is arranged so as to face the inner circumferential surface of the support plate 46.

In addition, a stepped portion 62 is formed between the tapered portion 56 and the small diameter portion 52. The fixing plate 48 is retained by the stepped portion 62.

The support plate 46 is formed in the shape of a disk having a predetermined thickness. A slide hole 64, through which the swing bolt 38 is inserted, is formed in the center portion of the support plate 46. The slide hole 64 is formed so as to be recessed, with a circular arc shape in cross section, in a direction separating away from the swing bolt 38, and the curved surface 60 of the tapered portion 56 that makes up the swing bolt 38 abuts with the slide hole 64. More specifically, the inner circumferential surface of the slide hole 64 corresponds to the curved surface 60 of the tapered portion 56 and is formed with substantially the same radius. Consequently, the swing bolt 38 is slidably retained in a center portion of the support plate 46 through the curved surface 60 thereof.

Further, because the slide hole 64 is gradually reduced in diameter in a direction away from the pistons 14*a*, 14*b* similar to the tapered portion 56 of the swing bolt 38, the swing bolt 38 cannot be displaced through the slide hole 64 in a direction separating away from the pistons 14*a*, 14*b*. Stated otherwise, displacement of the swing bolts 38 in the axial direction (the direction of arrows A and B) is regulated by the support plate 46.

On the other hand, a plurality of bolt holes 66, which are separated by equal intervals, are disposed on an outer circumferential region of the support plate 46. Fixing bolts 68 inserted through the bolt holes 66 are threaded respectively and screw-engaged with respect to the pistons 14*a*, 14*b*. As a result, the support plates 46 are fixed closely or in intimate proximity with respect to end surfaces of the pistons 14*a*, 14*b* on which the recesses 40 thereof are opened. Further, the outer diameter of the support plates 46 is set to be substantially the same as the outer diameter of the pistons 14*a*, 14*b* themselves.

The fixing plate 48 is formed in the shape of a disk, similarly to the aforementioned support plate 46, wherein the fixing plate 48 is attached to the stepped portion 62 of the swing bolt 38 through a hole 70, which opens in a central portion of the fixing plate 48. Additionally, the fixing plate 48 is disposed so as to be displaceable along the axial direction (the direction of arrows A and B) together with the swing bolt 38. In greater detail, the fixing plates 48 are sandwiched between the ends of the piston rod 26 and the large diameter portions 54 of the swing bolts 38, and relative displacement of the fixing plates 48 in the axial direction (the direction of arrows A and B) with respect to the swing bolts 38 is regulated.

Further, the fixing plate 48 is arranged and positioned so as to be separated a predetermined distance with respect to the support plate 46. That is, a clearance C2 (see FIG. 2) is provided between the fixing plate 48 and the support plate 46. The clearance C2 is disposed along the displacement direction (the direction of arrows A and B) of the pistons 14*a*, 14*b* and the piston rod 26. Further, the outer diameter of the fixing plates 48 is set to be smaller than the outer diameter of the support plates 46.

The center unit 20 is retained and supported between one of the cylinder tubes 12*a*, 12*b* and the other of the cylinder tubes 12*a*, 12*b*.

The center unit 20 includes a body 76 having first and second ports 72, 74 through which the pressure fluid is supplied and discharged, first check valves 78*a*, 78*b* for switching the communication state between the first port 72 and the pressure-increasing chambers 44*a*, 44*b*, second check valves 80*a*, 80*b* for switching the communication state between the second port 74 and the pressure-increasing chambers 44*a*, 44*b*, and the switching valve (switching section) 18 for switching between supplying the pressure fluid to the cylinder chambers 28*a*, 28*b* and discharging the pressure fluid from the cylinder chambers 28*a*, 28*b*, under a displacement action of the pistons 14*a*, 14*b*.

The first port 72 is connected to an unillustrated pressure fluid supply source and serves to supply the pressure fluid from the pressure fluid supply source. The first port 72 is connected to an introduction passage 82 that communicates respectively with the pair of pressure-increasing chambers 44*a*, 44*b*, and is equipped with an adjustment valve 84, which is capable of adjusting the flow rate of the pressure fluid. The first port 72 also is connected to a supply passage 86 that communicates with the fluid passages 30*a*, 30*b*. The adjustment valve 84 is disposed so as to enable adjustment of the pressure fluid flow rate, by an operator rotating a handle 88, which is disposed on an upper portion of the body 76.

The first check valves 78*a*, 78*b* are disposed in the introduction passage 82, respectively, on sides of the pressure-increasing chambers 44*a*, 44*b*. The first check valves 78*a*, 78*b* open for enabling the pressure fluid supplied to the introduction passage 82 to flow into the pressure-increasing chambers 44*a*, 44*b*, as well as to interrupt the flow of pressure fluid from the pressure-increasing chambers 44*a*, 44*b* to the introduction passage 82. That is, the first check valves 78*a*, 78*b* permit the flow of pressure fluid only in a direction toward the side of the pressure-increasing chambers 44*a*, 44*b*.

The switching valve 18 is disposed in the supply passage 86 on a downstream side from the adjustment valve 84. Under a switching action of the switching valve 18, a flow state is switched, in which the pressure fluid that passes through and is supplied from the supply passage 86 flows to the drive chamber 42*a* or 42*b* while passing through the fluid passage 30*a* or 30*b*.

The second port 74 is connected to a lead out passage 90 that communicates respectively with the pair of pressure-increasing chambers 44*a*, 44*b*. The second check valves 80*a*, 80*b* are disposed respectively in the lead out passage 90 on the side of the pressure-increasing chambers 44*a*, 44*b*. The second check valves 80*a*, 80*b* open so as to enable flow of the pressure fluid, which has been pressure boosted in the pressure-increasing chambers 44*a*, 44*b*, to the lead out passage 90, while also interrupting the flow of pressure fluid from the lead out passage 90 into the pressure-increasing chambers 44*a*, 44*b*.

That is, the second check valves 80*a*, 80*b* only permit the flow of pressure fluid that is lead out from the pressure-increasing chambers 44*a*, 44*b*. In addition, the pressure fluid, which is boosted in pressure in the pressure-increasing chambers 44*a*, 44*b*, passes through the lead out passage 90 and is output from the second port 74.

The body 76 having the aforementioned first and second ports 72, 74 also comprises a rod hole 92 therein that penetrates in an axial direction through the center of the body 76. The piston rod 26 is inserted through the rod hole 92, so as to be displaceable along the axial direction (the direction of arrows A and B).

The switching valve 18 has two ports that are connected respectively to the pair of fluid passages 30*a*, 30*b*, and acts to switch between the supply passage 86 and the exhaust port 94 with respect to these two ports.

The switching valve 18 is equipped with push rods 96*a*, 96*b*, which project outwardly into the pressure-increasing chambers 44*a*, 44*b* of the cylinder mechanism 16, and are disposed so as to be displaceable along the axial direction.

The push rods 96*a*, 96*b* are biased in directions toward the pressure-increasing chambers 44*a*, 44*b* by unillustrated springs. The communication states between the pair of fluid passages 30*a*, 30*b* with the supply passage 86 and the exhaust port 94 are switched by causing displacement of the push rods 96*a*, 96*b* in directions away from the pressure-increasing chambers 44*a*, 44*b* in opposition to the elastic forces of the springs. In other words, the switching valve 18 functions as a changeover switch, which is capable of switching between states of communication.

Further, the push rods 96*a*, 96*b* are disposed substantially parallel to the axial direction of the cylinder tubes 12*a*, 12*b*, and are arranged at positions which are offset from the rod hole 92 of the body 76, so as to confront the fixing plates 48 that make up the floating mechanisms 22. More specifically, upon displacement of the pistons 14*a*, 14*b*, the switching valve 18 is switched by means of the fixing plates 48 and the pistons 14*a*, 14*b* approaching toward and pressing the push rods 96*a*, 96*b*.

The pressure booster 10 according to the first embodiment of the present invention is constructed basically as described above. Next, operations and effects of the invention shall be explained. As shown in FIG. 1, an initial position is assumed, in which one of the pistons 14*a* is displaced toward the side of one of the end blocks 24*a* (in the direction of the arrow A).

In the initial position, upon supplying pressure fluid to the first port 72 from an unillustrated pressure fluid supply source, the pressure fluid flows through the introduction passage 82 and is introduced respectively into the pressure-increasing chambers 44*a*, 44*b* through the first check valves 78*a*, 78*b*.

On the other hand, a portion of the pressure fluid that is supplied from the first port 72 passes through the supply passage 86 and flows into the switching valve 18, after the flow rate thereof has been adjusted by the adjustment valve 84. Additionally, the pressure fluid that has passed through the switching valve 18 is supplied to one of the fluid passages 30*a*, passes through the communication conduit 32*a*, and is supplied to the drive chamber 42*a*.

In addition, the piston 14*a* is pressed toward the side of the center unit 20 (in the direction of the arrow B) by the pressure fluid that is introduced into the drive chamber 42*a*, whereupon the pressure fluid in the pressure-increasing chamber 44*a* is increased in pressure and pressure boosted by action of the piston 14*a*. The pressure boosted pressure fluid passes through the second check valve 80*a* and is directed to the second port 74 from the lead out passage 90, where it is output.

At the displacement terminal end position at which the one piston 14*a* is displaced toward the center unit 20 (in the direction of the arrow B), the fixing plate 48 of the floating mechanism 22 that is installed onto the piston 14*a* abuts against and presses the push rod 96*a* of the switching valve 18. As a result, the switching valve 18 is switched over, whereupon the pressure fluid supplied to the supply passage 86 passes through the other fluid passage 30*b* and is supplied to the other drive chamber 42*b*, and the other piston 14*b* is displaced toward the side of the center unit 20 (in the direction of the arrow A). Consequently, the pressure fluid in the pressing-increasing chamber 44*b* is boosted in pressure, and the pressure-boosted pressure fluid passes through the second check valve 80*b* and is output from the second port 74.

In addition, at the displacement terminal end position, at which the piston 14*b* is displaced to the side of the center unit 20 (in the direction of the arrow A), when the fixing plate 48 installed onto the piston 14*b* presses the push rod 96*b*, once again the switching valve 18 is switched over to the illustrated condition, and pressure fluid is supplied into the drive chamber 42*a*.

Figure 5:
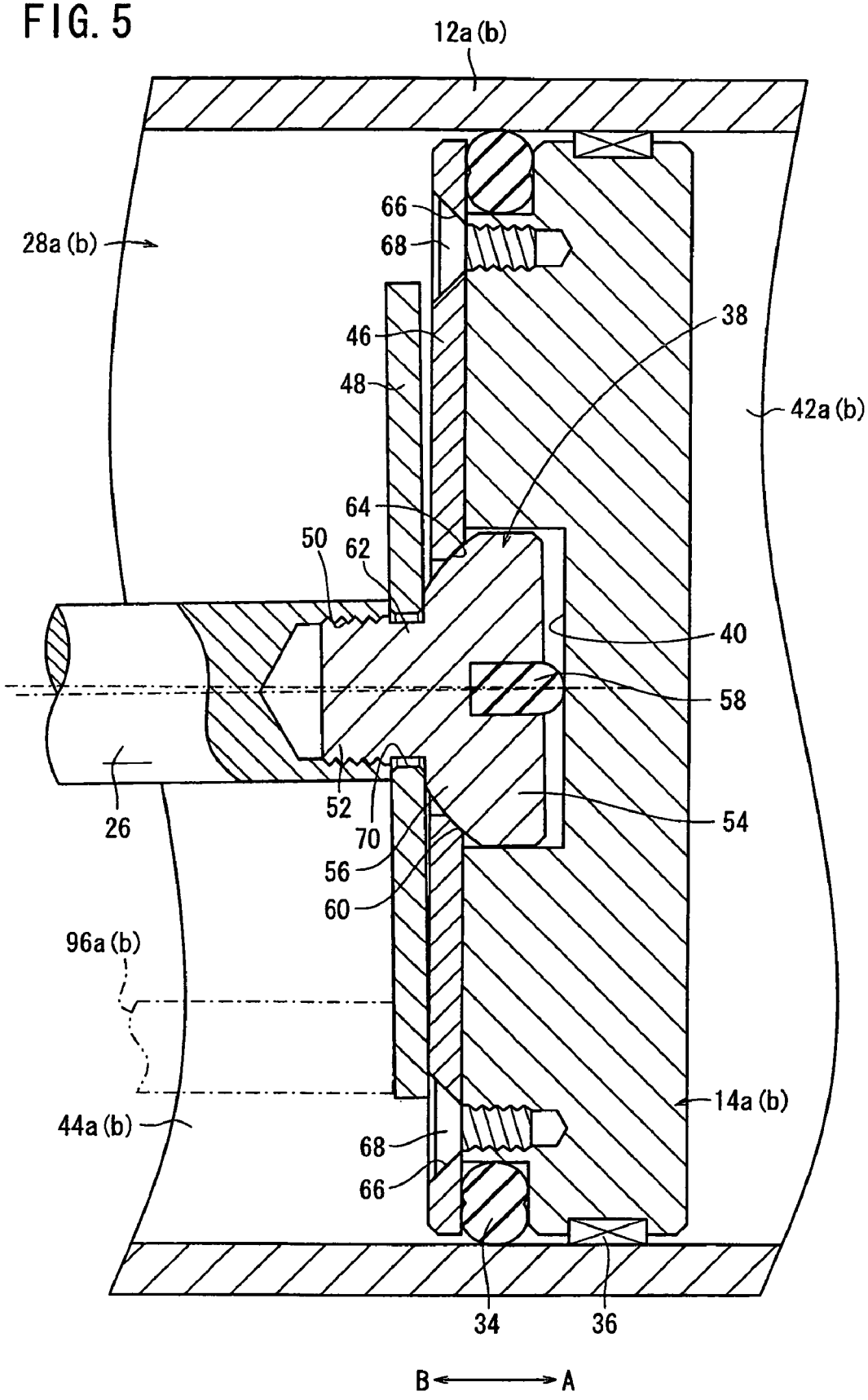
FIG. 5 is an enlarged cross sectional view showing a state in which a piston rod is disposed off center with respect to the piston, in the pressure booster shown in FIG. 2.

In the foregoing manner, according to the first embodiment, the floating mechanisms 22 are disposed respectively between the pair of pistons 14*a*, 14*b* and the piston rod 26, making up the cylinder mechanism 16. As shown in FIG. 5, in the event that the piston rod 26 becomes off centered with respect to the pistons 14*a*, 14*b* and the cylinder tubes 12*a*, 12*b*, the swing bolts 38 connected to ends of the piston rod 26 slide and are displaced along the slide hole 64 of the support plates 46 that are mounted on the pistons 14*a*, 14*b*. In this case, because the tapered portion 56 of the swing bolt 38 is provided with the curved surface 60 that bulges toward the outer side, the curved surface 60 is swingably displaced while sliding along the slide hole 64.

Consequently, even in the event that the piston rod 26 becomes inclined at a given angle by being offset, the imparting of offset loads to the pistons 14*a*, 14*b* from the piston rod 26 can be prevented, as a result of the swing bolts 38 swinging inside of the recesses 40 along the slide holes 64. Stated otherwise, offset loads imparted to the pistons 14*a*, 14*b* from the piston rod 26 can be suitably absorbed by the floating mechanisms 22. As a result, the pistons 14*a*, 14*b* can be displaced smoothly along the cylinder chambers 28*a*, 28*b* of the cylinder tubes 12*a*, 12*b*.

Accordingly, since the piston packings 34 and the wear rings 36 mounted in the outer circumferential surfaces of the pistons 14*a*, 14*b* remain in abutment evenly along the inner circumferential surface of the cylinder tubes 12*a*, 12*b*, uneven wearing of the piston packings 34 and the wear rings 36 can be prevented, and the durability thereof can be enhanced.

Further, in the floating mechanisms 22, the fixing plates 48 are provided, which confront the center unit 20, such that when the pistons 14*a*, 14*b* are displaced toward the side of the center unit 20, the fixing plates 48 are arranged so as to be capable of abutment against the push rods 96*a*, 96*b* of the switching valve 18. Thus, when the push rods 96*a*, 96*b* are pressed thereby switching over the switching valve 18, reaction forces applied to the pistons 14*a*, 14*b* can be received by the fixing plates 48.

As a result thereof, the swing bolts 38 are swingably displaced inside the recesses 40 of the pistons 14*a*, 14*b* by the reaction forces imparted to the fixing plates 48, and loads imparted to the fixing plates 48 can suitably be absorbed. Stated otherwise, the reaction forces from the push rods 96*a*, 96*b* are not applied directly to the pistons 14*a*, 14*b*.

Consequently, the pistons 14*a*, 14*b* can be displaced smoothly along the axial direction of the cylinder tubes 12*a*, 12*b*, and uneven wearing of the piston packings 34 and the wear rings 36, which would be generated in the case that offset loads were applied to the pistons 14*a*, 14*b*, can be prevented. As a result, the durability of the piston packings 34 and the wear rings 36 can be enhanced, thereby lengthening their service life.

Moreover, because the swing bolts 38 that make up the floating mechanisms 22 are structured so as to be capable of accommodation inside the recesses 40 of the pistons 14*a*, 14*b*, even when the floating mechanisms 22 including the swing bolts 38 are provided in the pressure booster 10, the lengthwise dimension of the cylinder mechanism 16 including the pistons 14*a*, 14*b* and the piston rod 26 therein is not increased in scale, and the pressure booster 10 having the floating mechanisms 22 can be manufactured compactly.

Figure 6:
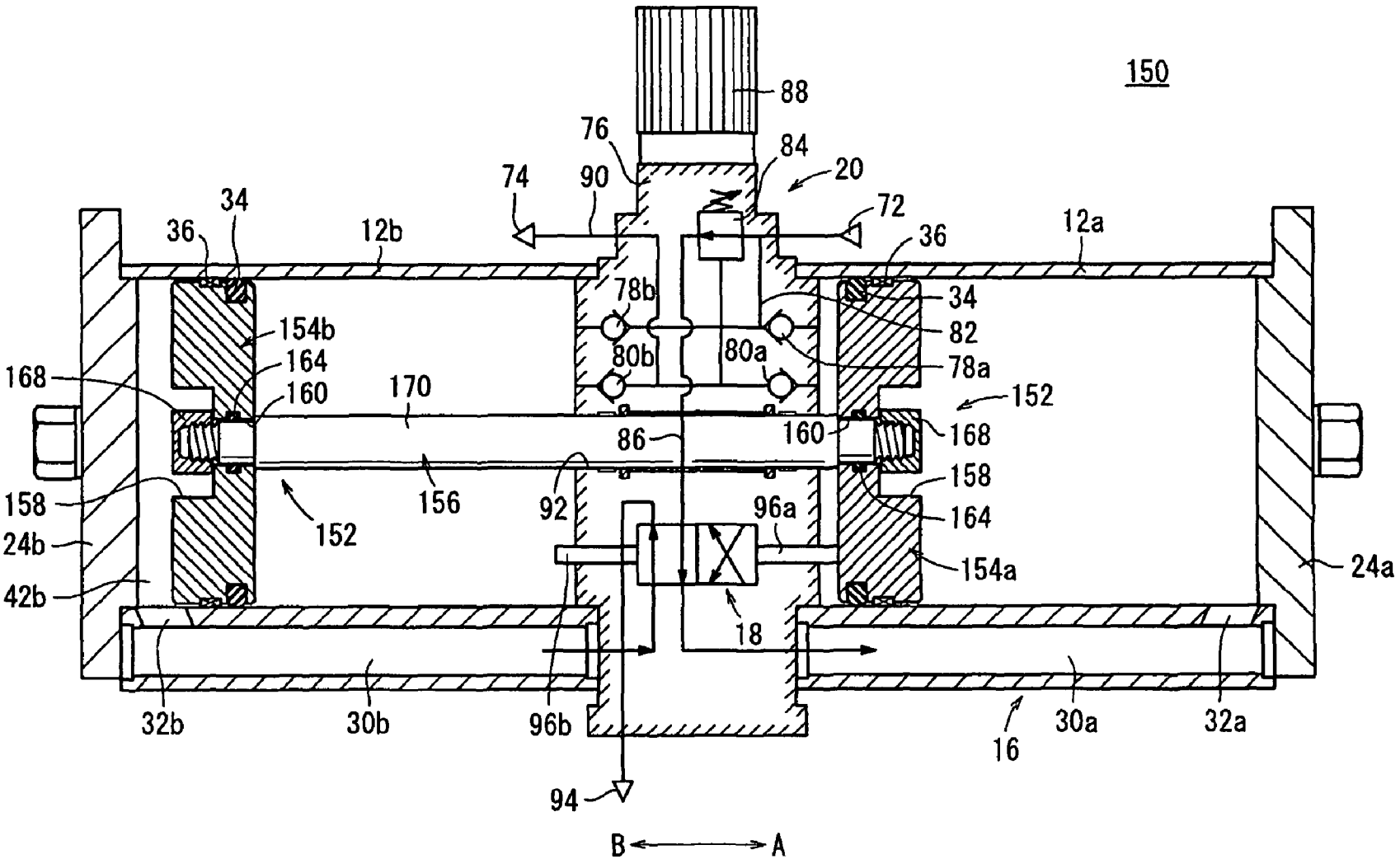
FIG. 6 is an overall vertical cross sectional view of a pressure booster according to a second embodiment of the present invention.
Figure 7:
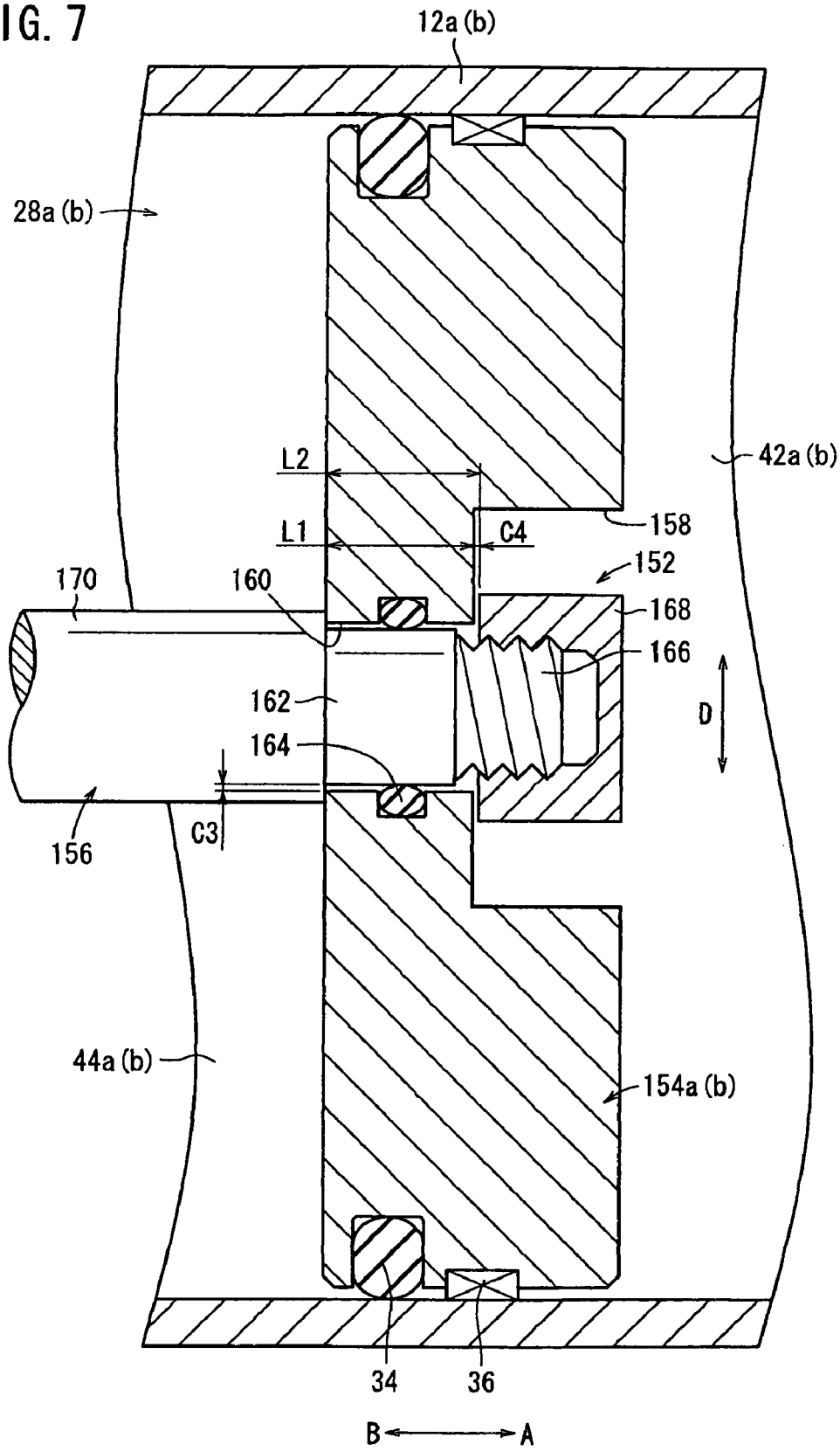
FIG. 7 is an enlarged cross sectional view showing the vicinity of a floating mechanism in the pressure booster of FIG. 6.

Next, a pressure booster 150 according to a second embodiment is illustrated in FIGS. 6 and 7. Structural features thereof, which are the same as those in the pressure booster 10 according to the first embodiment, are designated with the same reference numerals and detailed explanations of such features shall be omitted.

The pressure booster 150 according to the second embodiment differs from the pressure booster 10 according to the first embodiment in that the floating mechanism 152 thereof is constructed from a piston rod 156, which is connected so as to be displaceable slightly in both radial (the direction of the arrow D in FIG. 7) and axial (the direction of arrows A and B) directions with respect to pistons 154*a*, 154*b*.

The floating mechanism 152 is equipped with recesses 158 that open toward sides of the end blocks 24*a*, 24*b* on end surfaces of the pistons 154*a*, 154*b*. The recesses 158 communicate with piston holes 160 that penetrate through centers of the pistons 154*a*, 154*b*. Narrowed shaft portions 162 formed on ends of the piston rod 156 are inserted into the piston holes 160. Together therewith, rod packings 164 are installed into annular grooves provided on inner circumferential surfaces of the piston holes 160, surrounding the outer circumferential surfaces of the narrowed shaft portions 162.

Further, the inner diameter of the piston holes 160 is formed to be slightly larger than the outer circumferential diameter of the narrowed shaft portions 162, thereby establishing a clearance C3 between the piston hole 160 and the narrowed shaft portion 162. The clearance C3 is disposed in a perpendicular direction to the axial direction.

Moreover, threaded portions 166 are formed on ends of the narrowed shaft portions 162 at ends of the piston rod 156. Nuts 168 are threaded onto the threaded portions 166 and are accommodated within the recesses 158 of the pistons 154*a*, 154*b*. The ends of the piston rod 156 and the nuts 168 do not project outwardly from the recesses 158.

The piston rod 156 is connected such that the piston rod 156 is displaceable just slightly in the axial direction (the direction of arrows A and B) with respect to the pistons 154*a*, 154*b*. Specifically, as shown in FIG. 7, the length L1 along the axial direction of the piston hole 160 is set to be shorter than the length L2 extending from the border surface between the main axis 170 of the piston rod 156 and the narrowed shaft portion 162 to the end surface of the nut 168 (L1<L2). That is, a clearance C4 of a predetermined distance is disposed between the end surface of the nut 168 and the bottom surface of the recess 158.

In this manner, in the second embodiment as discussed above, in the event that the piston rod 156 becomes offset with respect to the cylinder tubes 12*a* and 12*b*, the end portions of the piston rod 156 having the nuts 168 threaded thereon are displaced in both radial (arrow D) and axial (arrows A, B) directions with respect to the pistons 154*a*, 154*b* via the clearances C3 and C4. Consequently, the imposition of offset loads from the piston rod 156 to the pistons 154*a*, 154*b* can be prevented. Owing thereto, the pistons 154*a*, 154*b*, which are connected to the offset (i.e., off centered) piston rod 156, do not themselves become off centered, and the pistons 154*a*, 154*b* can be displaced smoothly along the cylinder chambers 28*a*, 28*b* of the cylinder tubes 12*a*, 12*b*. In addition, because the piston packings 34 and the wear rings 36, which are installed on the pistons 154*a*, 154*b*, abut uniformly against the cylinder tubes 12*a*, 12*b* and do not experience uneven wearing, the durability thereof can be enhanced.

Further, compared with the floating mechanism 22 utilized in the pressure booster 10 according to the first embodiment, because the structure thereof is simplified, manufacturing costs and the number of assembly steps can be reduced.

In the pressure boosters 10, 150 according to the aforementioned first and second embodiments, explanations have been given concerning structures in which the floating mechanisms 22, 22 or 152, 152 are provided respectively with respect to the pair of pistons 14*a*, 14*b* or 154*a*, 154*b*. However, the present invention is not limited by this feature, and it is acceptable to provide the floating mechanism on either one side only. In this case, because only a single floating mechanism is provided, the number of component parts can be reduced, and further, the structure of the pressure booster can be simplified.

The pressure booster according to the present invention is not limited to the above-described embodiments, and various other structures may be adopted as a matter of course, which do not deviate from the essential nature and gist of the present invention.

What is claimed is:

1. A pressure booster having a supply port for supplying a pressure fluid, an outlet port through which a pressure fluid that has been increased in pressure is output, and a discharge port for discharging exhausted pressure fluid, wherein by a reciprocating movement of a pair of pistons that are connected to a piston rod and disposed respectively for displacement inside a pair of cylinder tubes, the pressure fluid that is introduced from said supply port is increased in pressure and output from said outlet port, comprising:

a cylinder mechanism having a pair of cylinder tubes equipped with cylinder chambers to which pressure fluid is supplied, a pair of pistons disposed for displacement inside said cylinder tubes, and a piston rod connected to both of said pair of pistons;

a center unit disposed between said cylinder tubes and having a switching section therein for switching a state of communication of the pressure fluid between said supply port and said outlet port and said cylinder chambers; and an offset absorbing mechanism disposed between said pistons and said piston rod, which is capable of absorbing an offset occurring between axial centers of said pistons and an axial center of said piston rod, wherein said offset absorbing mechanism includes a swinging member disposed between said pistons and said piston rod, said swinging member being swingably displaceable with respect to said pistons accompanying offset of said piston rod.

2. The pressure booster according to claim 1, wherein said offset absorbing mechanism comprises:

a supporting member mounted on an end surface of said pistons, which swingably supports said swinging member; and a recess formed in the end surface of said pistons into which said swinging member is inserted.

3. The pressure booster according to claim 2, wherein said offset absorbing mechanism includes an abutment member disposed on said piston rod and confronting said switching section, said abutment member abutting against a push rod of said switching section at a displacement terminal end position of said pistons.

4. The pressure booster according to claim 3, wherein a clearance (C2) separated by a predetermined distance along an axial direction of said pistons is provided between said supporting member and said abutment member.

5. The pressure booster according to claim 2, wherein said recess is disposed centrally on an axis of said pistons.

6. The pressure booster according to claim 5, wherein a clearance (Cl) is provided between said recess and said swinging member in a perpendicular direction with respect to an axial direction of said pistons, said swinging member being disposed displaceably inside of said recess.

7. The pressure booster according to claim 5, wherein a damper made of an elastic material is disposed on an end of said swinging member, said damper abutting against an inner wall surface of said recess.

* * * * *